US006464198B1

(12) United States Patent
Hugo

(10) Patent No.: US 6,464,198 B1
(45) Date of Patent: Oct. 15, 2002

(54) APPARATUS FOR MANUFACTURING WORKPIECES OR BLOCKS FROM MELTABLE MATERIALS

(75) Inventor: Oliver Hugo, Aschaffenburg (DE)

(73) Assignee: Ald Vacuum Technologies GmbH, Erlensee (DE)

( * ) Notice: Subject to any disclaimer, the term of this patent is extended or adjusted under 35 U.S.C. 154(b) by 0 days.

(21) Appl. No.: 09/445,318

(22) PCT Filed: Jul. 14, 1998

(86) PCT No.: PCT/EP98/04351

§ 371 (c)(1),
(2), (4) Date: Dec. 6, 1999

(87) PCT Pub. No.: WO99/03621

PCT Pub. Date: Jan. 28, 1999

(30) Foreign Application Priority Data

Jul. 16, 1997 (DE) ..... 197 30 378

(51) Int. Cl.[7] ..... B22D 27/04
(52) U.S. Cl. ..... 249/111; 164/127; 249/174
(58) Field of Search ..... 249/111, 174; 164/127

(56) References Cited

U.S. PATENT DOCUMENTS 1,976,386 A * 10/1934 Carnegie et al. ..... 249/111
2,420,003 A 5/1947 Miller
3,321,932 A * 5/1967 Orphey, Jr. ..... 249/111
3,620,289 A * 11/1971 Phipps, Jr. ..... 164/127
3,939,895 A * 2/1976 Sawyer ..... 164/127

FOREIGN PATENT DOCUMENTS

| | | |
|---|---|---|
| DE | 1558322 | 5/1970 |
| DE | 2252548 | 5/1973 |
| DE | 2646060 | 4/1978 |
| DE | 3001815 | 7/1980 |
| DE | 3323896 | 1/1985 |
| GB | 2279585 | 1/1995 |

OTHER PUBLICATIONS

"Recent Progress in Electromagnetic Casting for Polycrystalline Silicon Ignots", Technical Digest of the International PVSEC–9, Miyazaki, Japan, 1996.

* cited by examiner

*Primary Examiner*—James P. Mackey
(74) *Attorney, Agent, or Firm*—Milde & Hoffberg, LLP

(57) ABSTRACT

Apparatus for the producing workpieces and blocks from meltable materials in which a liquid starting material is solidified in a directional manner in a casting mold using a cooling device. For the controlled guiding of the solidification front during cooling of the molten material a cooling structure having a plurality of heat conducting bodies is introduced from below into a corresponding recesses of a body assigned to the bottom of the casting mold.

21 Claims, 3 Drawing Sheets

APPARATUS FOR MANUFACTURING WORKPIECES OR BLOCKS FROM MELTABLE MATERIALS

BACKGROUND OF THE INVENTION

The present invention relates to a method for manufacturing workpieces or blocks from meltable materials, where the material, starting as a liquid is solidified in a directed manner in a casting mold by using a cooling device.

The invention additionally relates to a device for manufacturing workpieces or blocks from meltable materials using a casting mold that is heatable using a heating device and where a cooling device is assigned to the base of the casting mold.

Subsumed under the term "meltable materials", as it is used here, are materials made of ceramics, including sapphires, rubies, spinels, etc., metals, metal alloys, or materials from the group of semiconductors with an oriented multi-crystalline or mono-crystalline structure.

With such methods as relate to the invention, as well as the respective devices, the starting material is either provided to the casting mold in the liquid phase or is melted in the casting mold and thereafter solidified in a directed manner in the casting mold.

Such a type of solidification guiding is known in various prior known methods. According to one method, or the corresponding device, respectively, described in GB-A-2 279 585, the casting mold with the melt is pulled downwards out of a heating furnace. This results in the solidification front progressing from bottom to top. For long components or materials with a low thermal conductivity, the influence of an applied cooling plate becomes insignificant after just a few centimeters. After that, heat removal occurs basically on the sides via the chill surface, which in practical applications does not enable setting an essentially plane phase boundary between already solidified and liquid melt material. This method is not suitable for manufacturing large-surface blocks solidified in a directed manner because with large cross-sections, the heat conducting paths from the center of the block to the heat removing surfaces on the sides are too long making it impossible to achieve plane phase boundaries in connection with sufficiently high temperature gradients.

In the Technical Digest of the International PVSEC-9, Miyazaki, Japan 1996, Ritsua Kawamura et al. show in "Recent Progress in Electromagnetic Casting for Polycrystalline Silicone Ingots" that the phase boundary between solid and liquid silicon has a significant concave shape. Parallel radial crystalline structures cannot be achieved using this method. The maximum block size is described as 22 cm×22 cm.

Larger silicon blocks solidified in a directed manner are manufactured according to the state-of-the-art in blocks of 66 cm×66 cm and a height of 2.5 cm using the HEM Method (Heat Exchanger Method). With the HEM Method, according to the state-of-the-art, the energy required to maintain the solidification speed and the temperature gradient is removed across a central area of the chill bottom. With a constant temperature of the heater located above the melt surface, the heat transfer coefficient between the base of the chill and the cooling plate essentially determines the heat removal flow, and thus, the speed of growth of the crystalline block.

SUMMARY OF THE INVENTION

It is the objective of the present invention, beginning with the state-of-the-art described above, to develop a method and device with the features mentioned above, such that the solidification of the melt can be guided in a defined manner and where the initiation of the cooling phase can be continuously advanced from the heating phase to the cooling phase. In addition, the device and the method shall offer a broad variation with simple means of design with regard to this definably guided solidification in a defined manner.

This objective is accomplished with the above mentioned method such that a cooling structure with at least one thermal conductor is inserted in a least one corresponding recess from the bottom side into the body assigned to the base of the casting mold in order to accomplish a defined guiding of the solidification front during the cooling phase of the molten material.

With regard to a device, the objective is accomplished in that the above mentioned device is characterized in that the cooling device contains a cooling structure with at least one thermal conductor that can be inserted from the bottom into at least one corresponding recess in a body assigned to the base using a sliding mechanism.

Using the described method and device, the solidification of the material starting as a liquid that was poured into the casting mold can be carried out in a defined guided manner beginning at the base of the casting mold by inserting the thermal conductor in different positions into the recess of the body assigned to the base of the casting mold. By adjusting the at least one thermal conductor in the at least one recess assigned to this body, the heat transfer, and thus the cooling performance, can be set in a defined manner and can be changed as well. Through the respective geometry of the thermal conductor and its corresponding recess, it is additionally possible to influence the solidification front that moves from the base upwards. Depending on the number of thermal conductors and the corresponding recesses of the used cooling structure, crystallization speeds of 0.2 mm/min to 2 mm/min can be achieved with cooling performances in a range from 10 to 150 kW per $m^2$.

In order to change the amount of removed heat per unit of time in addition to adjusting the thermal conductor in the corresponding recess, it may also be advantageous to maintain a gaseous atmosphere with an adjustable pressure surrounding the cooling structure. By lowering the gas pressure to a few mbar, the performance density can be controlled more sensitively. Furthermore, a gaseous atmosphere of Argon should be maintained around the heat conducting body in such a case, where continued purging is carried out with such a gas because, especially with Argon, additional contamination can be removed from the heating space.

As already indicated, the cooling structure may contain several thermal conductors that can be inserted in slots and/or blind holes of the body that is assigned to the base of the casting mold. Suitable thermal conductors are plates, bolts and/or bars that may additionally be designed with different cross-sectional geometries. In an embodiment that should be emphasized especially, a heating device is positioned underneath the base of the casting mold such that the one or more thermal conductors in the inserted position penetrate through the heating device into the body that is assigned to the bottom side of the base. With such an arrangement, the transition between heating and cooling of the casting mold can not only be determined by the insertion of the thermal conductors into the recess(es), but also through additional control of the heating device, since it also essential to heat the base of the casting mold for maintaining the liquid phase of the starting material. For this purpose, the heating device may be placed in a carrier plate that is assigned to the base of the casting mold and that carries the casting mold. The carrier plate is then provided with holes or recesses that serve the purpose of changing the outer surface that is available overall for heat transfer in a broader range than would be possible with the bottom surface of the base of the casting mold alone.

Preferred dimensions of such thermal conductors are diameters or thicknesses and/or width of 5 mm to 20 mm, preferably of 10 mm to 14 mm. Furthermore, the width of the web remaining between neighboring recesses in the body in which the thermal conductors are inserted should be between 5 and 20 mm. Furthermore, the insertion depth of the thermal conductors into the body should be at least 20 mm to be able to adjust the cooling performance over a sufficient range. However, the individual thermal conductors may have a significantly greater length than corresponds to an insertion depth of 50 mm, that is, the height of the thermal conductor may be between 100 and 150 mm, preferably about 130 mm.

In the simplest case, the thermal conductors are designed as round pins. For reasons of stability, the diameter of such a thermal conductor in its design as a round bolt should not be selected to be less than 10 mm. The ratio between the effective exchange surface and the flat surface with a remaining web width of 10 mm with a bolt diameter range of 10 mm to 20 mm is practically independent of the selected bolt diameter. To further increase the cooling performance, the individual thermal conductors may have a cross section in the shape of a cross or star. Such thermal conductors then enter recesses in the body assigned to the base of the casting mold where the shape of the cross-section of said recesses is adapted to the shape of the element, such that large areas are provided both in the recesses and on the cooling elements. To have as large a range of cooling performance as possible, with the cooling power being adjustable, the ratio of the sum of the cross-sectional areas of the thermal conductors to the sum of the cross-sectional areas of the recesses should be between 1.5:1 and 5.5:1. This results in possible cooling powers of about 10 to 150 $kW/m^2$.

The movement of the thermal conductors in the recesses of the body that is assigned to the casting mold can be easily realized, technically, with a lifting mechanism. With a stroke of 50 mm and a thermal conductor made of copper with a diameter of 12 mm and an effective height of the thermal conductor of 130 mm and a hole distance of 26 mm and a hole diameter of 14 mm, a heat transfer coefficient of about 10 $W/(m^2 \times K)$ to about 240 $W/(m^2 \times K)$ can be set for a 1000 mbar Argon atmosphere between carrier plate and thermal conductor at a carrier plate temperature of 1400° C. These values correspond to about 1400 to 1500 thermal conductors per square meter.

The thermal loss through the thermal insulation is negligible due to the small ratio of diameter to hole length, such that, with a retracted cooling structure, the thermal losses through the open penetrations are tolerable.

It is further possible to control the removed energy density even more sensitively by reducing the gas pressure to a few mbar. For this purpose, the entire cooling structure can be arranged in a chamber with an adjustable pressure. For effective heat removal, it is particularly advantageous if the body is an integral part of the base of the casting mold and furthermore, if this base is textured, for example with elevations and depressions, where the respective thermal conductors are moved into or are retracted from the bottom in respective holes in the elevations of the base of the casting mold.

As already mentioned above, the device subject to the invention enables setting a temperature profile directly above the chill or casting mold base surface. Through this special design of the chill or casting mold base, the radial crystallization can be influenced in the area of the depressions, viewed from the base area. The lowest points of these individual depressions are aligned with the respective thermal conductors such that crystallization starts at the lowest (coldest) points of the chill base. In this manner, a slightly planar or slightly convex phase boundary between solid and liquid material can be set intentionally to achieve a certain objective, for example, to initiate a thermal convection. Research has shown that, especially when taking the objective of cleaning into account, a slightly curved phase boundary is advantageous in directed (controlled) solidification.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
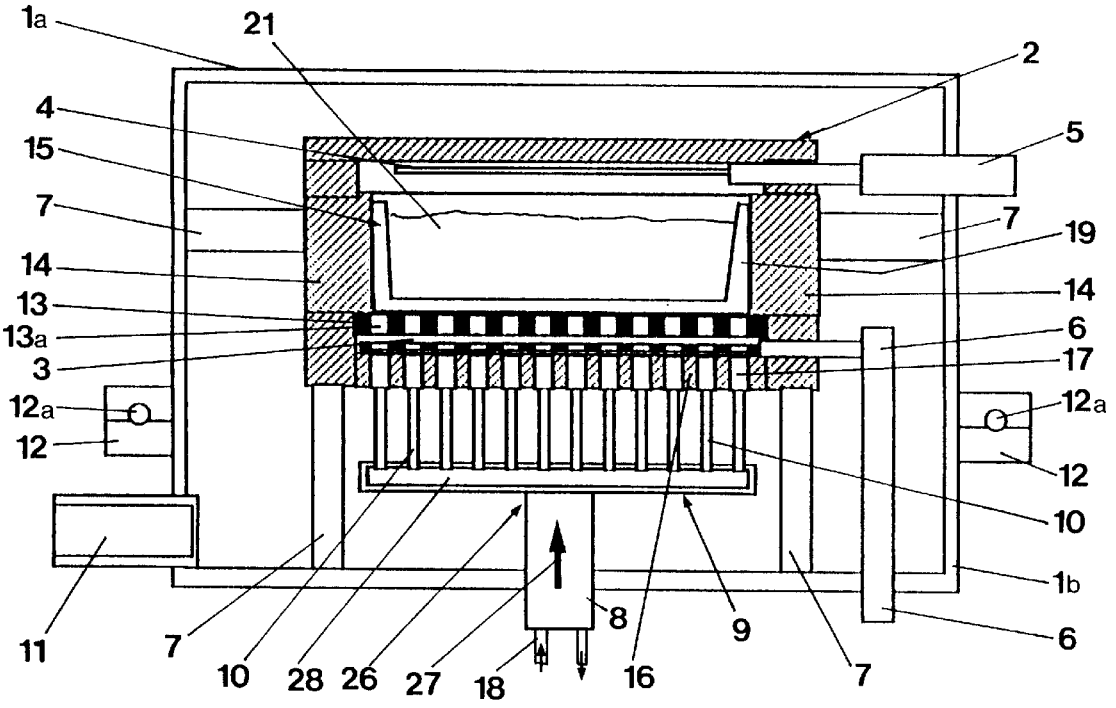
FIG. 1 is a schematic cross-section of a melt device according to the invention, where the cooling structure is presented with thermal conductors retracted from the recesses.

The present invention will now be described with reference to FIGS. 1-4 of the drawings. Identical elements in the various figures are identified by the same reference numerals.

Figure 2:
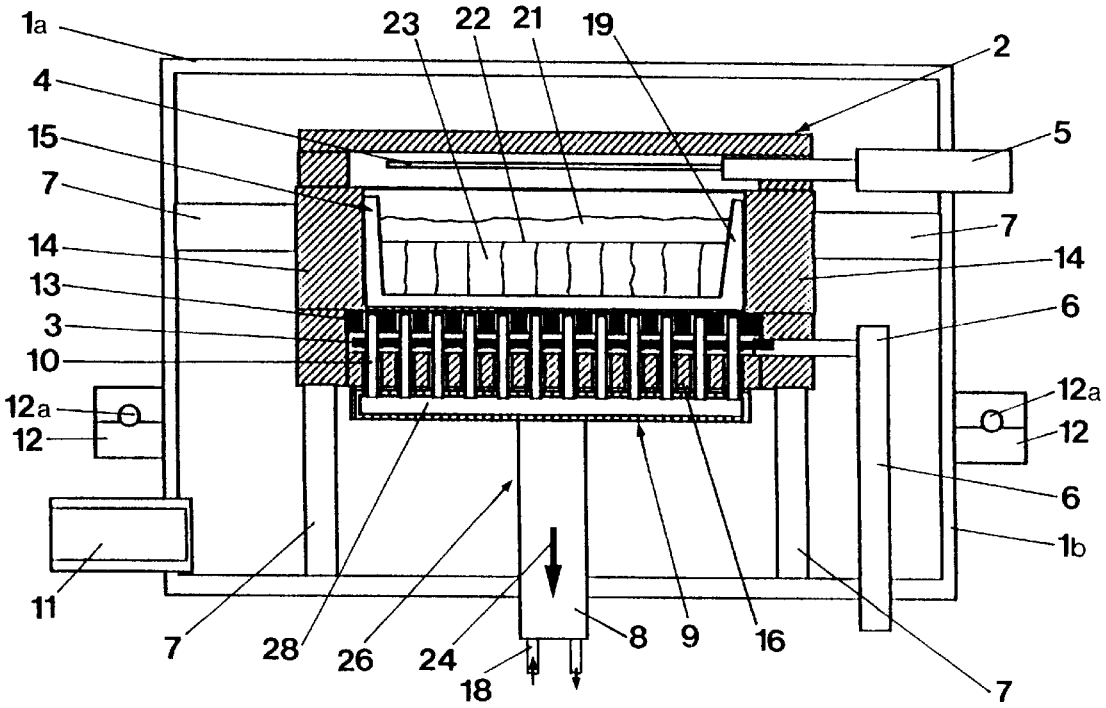
FIG. 2 shows the device presented in FIG. 1, however with the thermal conductors inserted in the recesses.

As FIGS. 1 and 2 show, the melt device consists of an oven with an upper oven chamber la and a lower oven chamber 1*b*, in which a casting mold or a chill mold 15, provided on its outer side with thermal insulation 2, is held by suitable supports 7. The thermal insulation 2 is provided with side thermal padding 14, bottom thermal padding 16 and top thermal padding 20 such that the chill is surrounded on all sides with this thermal insulation 2. The upper oven chamber 1*a* is connected to the lower oven chamber 1*b* with a flange connector 12, which contains a gasket 12*a*, such that the oven chamber 1*a*, 1*b* can be opened by removing the upper oven chamber la and can again be closed tightly. A lower heating device 3 is located underneath the base 19 of the chill 15. Additionally, an upper heating device 4 is located above the chill. The two heating devices 3 and 4 are supplied with electric current via current supply leads 5 and 6 to enable setting of the respective heating power 3, 4. The space between the upper and the lower heating chamber la and 1*b* and the chill 15, or the thermal insulation 2 surrounding the chill 15, respectively, can be evacuated via an evacuation connector 11 to change the pressure within this chamber 1*a*, 1*b*.

As mentioned above, the chill 15, or the chill together with the thermal insulation 2, is kept on supports 7 such that sufficient space is kept between the base of the lower oven chamber 1*b* and the chill base 15. A cooling structure 26 is located in this area, that is, underneath the base of the chill 15, where said cooling structure contains a cooling plate 9 from which protrude individual thermal conductors 10 that are at a certain distance from one another. Recesses 17 are assigned to these individual thermal conductors 10, where said recesses pass through both the lower thermal padding 16 and the carrier plate 13, which supports the base of the chill 15.

Furthermore, these recesses 17 are aligned in relation to the lower heating device 3 located in the area of the chill carrier plate 13 chill such that they pass between the individual coils of the heating device 3 and reach into the chill carrier plate 13 in the shape of blind holes 13a.

The cooling plate 9 is held by a lifting piston 8 such that it can move up in the direction of the arrow 27 shown in FIG. 1, such that the individual thermal conductors 10 can be inserted into the corresponding recesses 17. In addition, the lifting piston 8 has a cooling water feed and drain 18 allowing forced cooling of the cooling plate 9, which has a respective hollow space 28 for the cooling medium.

To manufacture a workpiece or a block from a meltable material, the molten liquid material is poured into the casting mold or chill 15, which has been pre-heated to the melting temperature, or it is melted in the chill. Thereafter, the pouring hole is closed, for example with a lid placed on the chill 15, and the melt is left alone for a preset time to allow for floating or sedimentation of contaminants. Thereafter, the lower heating device 3 is switched off and the cooling structure 26, or the thermal conductors 10 assigned to it, are moved into the recesses 17 in the lower thermal padding 16 and the chill carrier plate 13 with a fixed preset speed. Alternatively to a preset speed, the position control of the respective position of the cooling structure 26 in the recesses 17, or the blind holes 13*a* in the chill carrier plate 13 can be performed in relation to the cooling power to be removed. During the time of cooling with the cooling structure 26, the cooling medium is continuously forced to the cooling plate 9 via the cooling medium feed and drain pipes 18. Via the evacuation connector 11, the oven chamber can be evacuated if required, which is always necessary or advantageous when oxidationsensitive materials are used.

FIG. 2 shows the assembly of FIG. 1 with the thermal conductors 10 of the cooling structure 26 completely moved into the chill carrier plate 13. In this position, the lower heating device 3 is switched off and the upper heating device 4 is still operated and set or controlled to a temperature that keeps the surface of the melt 21 above the melting point. Heat removal required for crystallization is carried out via the already solidified portion of the block 23 and the chill base and from there to the chill carrier plate 13. From the chill carrier plate 13, the heat flows via the gap between holes/recesses 17, 13*a* and the thermal conductors 10 to the cooling plate 9, where it is transferred to the cooling medium. It is apparent that the amount of heat to be removed can be set or controlled very sensitively through the insertion depth of the thermal conductors 10 into the chill carrier plate 13. In this manner, the solidification of the block and the formation of radial crystals can be set and guided very precisely beginning at the base of the chill.

After the block 23 is solidified, the cooling structure 26 is moved downwards in the direction of the arrow 24 shown in FIG. 2 such that is completely disengaged from the chill carrier plate 13 as well as the lower thermal padding 16. Then, the heating temperature of the upper heating device 4 is reduced to a temperature below the solidus temperature. Now, the lower heating device 3 is switched on and its temperature is set to the temperature of the bottom of the block. The heating temperature is increased in a controlled manner to the value of the upper heating device 4. After temperature equalization in the oven chamber, the temperature in the oven chamber is kept for a preset holding time. Thereafter, the heating temperature of the upper and lower heating devices 3, 4 is reduced in a programmed manner.

Figure 3A:
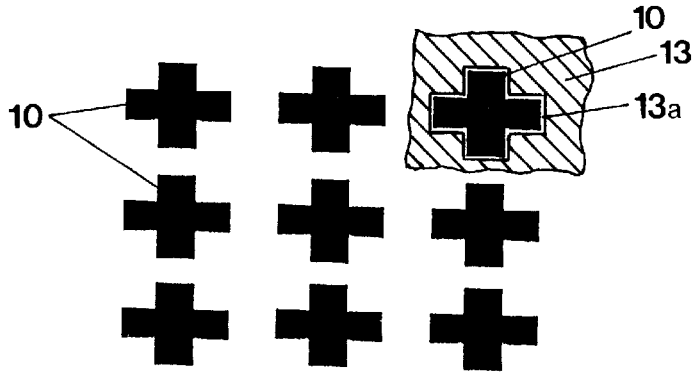
FIGS. 3A to 3C show three different possible shapes of cross-sections for the thermal conductors as can be employed in the devices according to FIGS. 1 and 2.
Figure 3B:
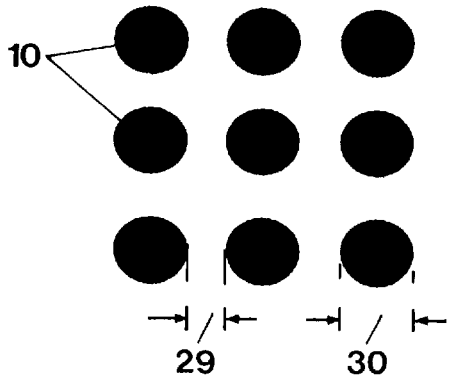
Figure 3C:
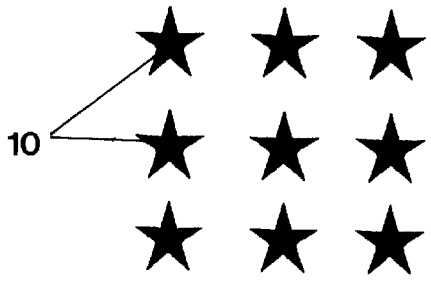

FIGS. 3A to 3C show three different shapes of cross-sections for thermal conductors 10, as can be used in the assembly described above using FIGS. 1 and 2. FIG. 3A shows as an example of a field with a total of 9 thermal conductors 10 exhibiting a cross-section in the shape of a cross. The recesses 13*a* in the chill carrier plate 13*a* are, as indicated on the upper right side of FIG. 3A, shaped correspondingly to the cross-section of the thermal conductors 10, such that a small gap remains between the wall of the recesses 13*a* in the chill carrier plate 13 and the respective inserted thermal conductor 10. By using this cross shape, the thermal conductors 10 can be provided with large surfaces to achieve a great thermal transfer via these thermal conductors 10.

FIG. 3B shows an arrangement of nine thermal conductors 10, each with a circular cross-section. Such thermal conductors 10 then enter into recesses 13*a* (not shown) with a corresponding cross-sectional shape, such that again a small gap remains as shown in FIG. 3A. A third cross-sectional shape for the thermal conductors 10 is shown in FIG. 3C, where the cross-sections are in the shape of stars. Using this star shape, an even greater surface area can be achieved than in the arrangement shown in FIG. 3A depending on the number of points or fins.

The specific surfaces according to the respective shapes of the cross-sections in FIGS. 3A, 3B and 3C should be selected taking into account the temperature, the thermal conductivity, the length of the thermal conductors 10 and the mechanical stability. For example, the thermal conductors 10 should have a thickness and/or width, designated in FIG. 3B with the reference number 30, of 5 to 20 mm, preferably 10 to 14 mm. Neighboring thermal conductors 10 should be at a distance of about 50 mm, or the width of the web remaining between neighboring thermal conductors, with the width designated in FIG. 3B with reference No. 29, should be 50 mm. The length, or height, of the thermal conductors, that is, in the direction perpendicular to the drawing plane in FIGS. 3A to 3C should be in a range of 100 to 150 mm, preferably about 130 mm.

As already indicated above, the oven chamber may be filled with gas, preferably Argon, and the pressure in the oven chamber can be controlled during the cooling phase or during the movement of the cooling structure 26 in the direction of the chill carrier plate 13. The pressure is set such that the entire stroke height of the thermal conductors is utilized to achieve a very sensitive control behavior.

Figure 4:
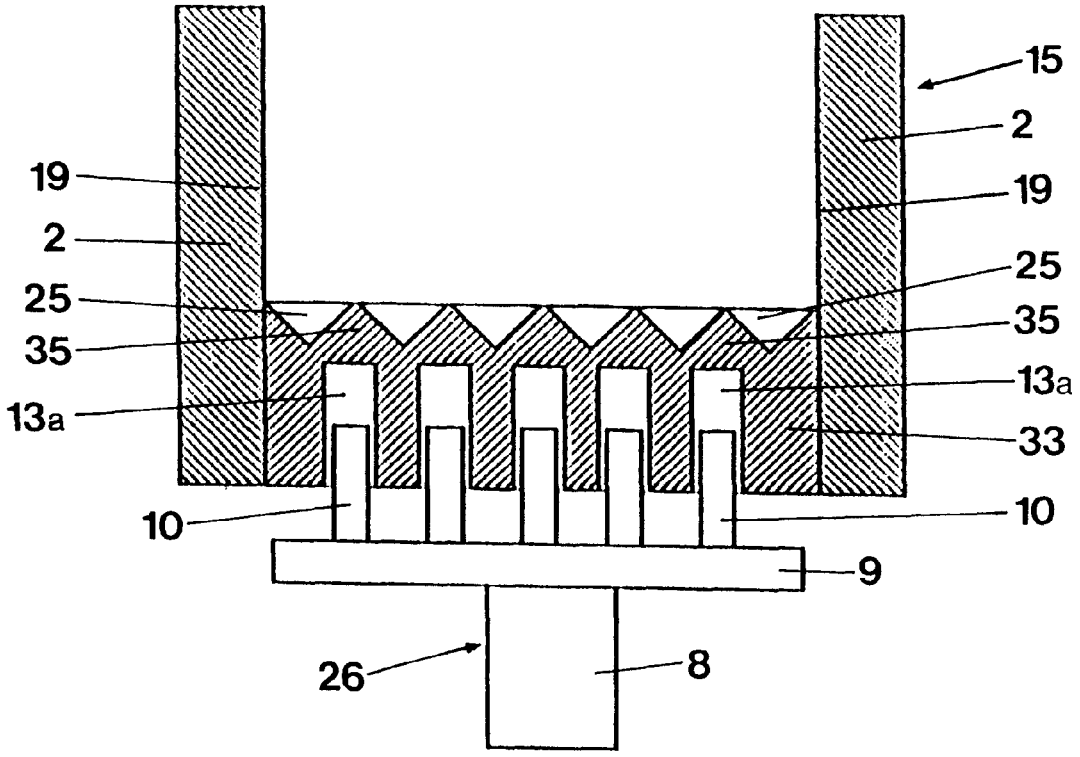
FIG. 4 shows the schematic design of a device, where the thermal conductors can be moved in recesses that are formed directly in the base of the casting mold and where furthermore the base of the casting mold is textured.

FIG. 4 is the schematic presentation of a chill 15 with a thermal insulation 2. In this embodiment, no particular chill carrier plate 13*a* for holding the base of the chill is present, such as is the case in the devices shown in FIGS. 1 and 2; instead, the base of the chill itself, designated in FIG. 4 with the reference number 33, is provided with holes or recesses 13*a*, where again the respective thermal conductors 10 of the cooling structure 26 enter. Furthermore, the chill base 33, assigned to the melt, is textured such that individual depressions 25 and elevations 35 are provided with, for example, a triangular cross-section to increase the thermal exchange surface. As is apparent in FIG. 4, here the respective recesses 13*a* are arranged such that they each are assigned to a respective elevation 35 in the texture of the chill base 33. This texture of the chill base with the depressions 25 is also advantageous to provide starting points for the crystalline growth at the respective depressions. It is clear that the side walls 19 of the chill 15 are tightly connected with the chill base 33.

With the devices presented in FIGS. 1 and 2 as well as in FIG. 4, taking into account the respective cross-sectional shapes of the thermal conductor 10, cooling powers can be achieved in a range from 10 to 150 $kW/m^2$ due to different positioning of the thermal conductors 10 in the respective recesses 13*a*, such that the respective solidification speed can be set in a defined manner. Furthermore, in a continued development of the device as presented, the individual thermal conductors can be moved differently to one another to remove different amounts of heat at different places of the chill base through different positions in the respective recesses 13*a*. For example, in a particular embodiment, the outer thermal conductors 10 can be inserted into the respective recesses 13*a* sooner or later than the thermal conductors 10 closer to the center to adjust the solidification profile or the solidification front; for this purpose, the lifting mechanism, or the lifting piston 8, respectively, shown in the Figures would have to be divided into several individual lifting pistons assigned to the respective thermal conductors.

There has thus been shown and described a novel method and device for manufacturing workpieces or blocks from meltable materials which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a device for manufacturing workpieces or blocks from meltable materials using a casting mold that can be heated with a heating device and where a cooling device is mounted adjacent to the base of the casting mold, the improvement wherein the cooling device includes a cooling structure with a plurality of thermal conductors and comprising a moving mechanism for inserting the thermal conductors into a plurality of corresponding recesses in a body adjacent the base from below the body.

2. Device as set forth in claim 1, wherein a heating device is arranged adjacent to the base of the casting mold and wherein, when inserted in their respective recesses, the thermal conductors penetrate the heating device.

3. Device as set forth in claim 1, wherein the thermal conductors are formed of plates, bolts and/or bars.

4. Device as set forth in claim 1, wherein the thermal conductors exhibit a thickness and/or width 5 mm to 20 mm.

5. Device as set forth in claim 1, where in the width, between neighboring recesses in the body is between 5 and 20 mm.

6. Device as set forth in claim 1, wherein the insertion depth of the thermal conductors into the body is at least 20 mm.

7. Device as set forth in claim 1, wherein the height of the thermal conductors is between 100 and 150 mm.

8. Device as set forth in claim 1, wherein further comprising means for purging the space between the thermal conductors and the respective recesses with Argon.

9. Device as set forth in claim 1, each thermal conductor perpendicular to its height has a cross or starshaped cross-section, and wherein each recess corresponds to this respective cross section.

10. Device as set forth in claim 1, wherein further comprising means for force-cooling the thermal conductors with a cooling medium at least at their ends opposite the body.

11. Device as set forth in claim 1, wherein the body is an integral part of the base of the casting mold.

12. Device as set forth in claim 1, wherein the body forms a carrying structure onto which the casting mold is placed.

13. Device as set forth in claim 1, wherein the base of the casting mold exhibits elevations and depreession on a side in contact with the meltable materials.

14. Device as set forth in claim 13, wherein a recess reaches into an elevation.

15. Device as set forth in claim 1, wherein the cooling structure is located in a chamber with an adjustable pressure.

16. Device as set for th in claim 4, wherein the thermal conductors exhibit a thickness and/or width of 10 to 14 mm.

17. Device as set forth in claim 7 wherein the height of the thermal conductors is about 130 mm.

18. Device as set forth in claim 1, wherein said recesses are in the form of slots.

19. Device as set forth in claim 1, wherein said recesses are in the form of blind holes.

20. In a device for manufacturing workpieces or blocks from meltable materials using a casting mold that can be heated with a heating device and where a cooling device is mounted adjacent t the base of the casting mold, the improvement wherein the cooling device includes es a cooling structure with at least one thermal conductor and comprising a moving mechanism for inserting the thermal conductor into at least one corresponding recess in a body adjacent the base from the bottom of the body wherein a heating device is assigned to the base of the casting mold and wherein, in the inserted condition, the thermal conductor penetrates the heating device.

21. In a device for manufacturing workpieces or blocks from meltable materials using a casting mold that can be heated with a heating device and where a cooling device is mounted adjacent the base of the casting mold, the improvement wherein the cooling device includes a cooling structure with at least one thermal conductor and comprising a moving mechanism for inserting the thermal conductor into at least one corresponding recess in a body adjacent the base from the bottom of the body wherein the base of the casting mold exhibits elevations and depressions on the side that points to the melt and wherein the recess reaches into an elevation.

* * * * *